United States Patent [19]

Trippner et al.

[11] Patent Number: 4,944,341

[45] Date of Patent: Jul. 31, 1990

[54] INSULATING GLASS WINDOW WITH LIGHT GUARD

[76] Inventors: Edmund Trippner, Grüntenweg 9, D-7440 Reudern; Heinz Thierer, Steiglesäcker 9, D-7312 Kirchheim/Teck, both of Fed. Rep. of Germany

[21] Appl. No.: 315,555

[22] Filed: Feb. 24, 1989

[30] Foreign Application Priority Data

Mar. 2, 1988 [DE] Fed. Rep. of Germany ..... 3806648

[51] Int. Cl.[5] ..... A47H 1/00

[52] U.S. Cl. ..... 160/98; 160/31

[58] Field of Search ..... 160/98, 107, 85, 86, 160/23.1, 310, 31, 32, 33

[56] References Cited

U.S. PATENT DOCUMENTS

| | | | |
|---|---|---|---|
| 2,088,738 | 8/1937 | Fox | 160/107 |
| 2,530,218 | 11/1950 | Barrows | 160/98 |
| 2,631,339 | 3/1953 | Pratt | 160/107 X |
| 2,854,102 | 9/1958 | Peeples | 160/107 X |
| 3,186,473 | 6/1965 | Myers et al. | 160/98 X |
| 4,197,896 | 4/1980 | Reichstadt | 160/107 |
| 4,407,349 | 10/1983 | Ekström | 160/98 |
| 4,649,980 | 3/1987 | Kunz | 160/98 |

*Primary Examiner*—David M. Purol

*Attorney, Agent, or Firm*—Toren, McGeady & Associates

[57] ABSTRACT

An insulating glass window with two panes separated from each other by a sectional frame serving as a spacing member. The window further includes a replaceable light guard device with a light guard sheet which is movable in the space between the panes. An electric motor drives the light guard device. The entire light guard device is arranged in the space between the panes and is supported in opposite frame sides. At least one of the frame sides has an opening for the assembly and disassembly of the light guard device. The opening can be closed in a gas-tight manner by a cover.

5 Claims, 2 Drawing Sheets

INSULATING GLASS WINDOW WITH LIGHT GUARD

BACKGROUND OF THE INVENTION

1. Field of the Invention

The present invention relates to an insulating glass window with two panes separated from each other by means of a sectional frame serving as a spacing member. The window further includes a replaceable light guard device in the form of a shutter or shade with a light guard sheet or web which is movable in the space between the panes. An electric motor is provided for driving the light guard device.

2. Description of the Related Art

German Offenlegungsschrift No. 15 09 366 discloses a double-pane window which includes two panes glued onto a spacer frame and a replaceable light guard device in the form of a foldable shutter or shade which is mounted so as to be movable between the two panes. The window includes a separate casing for receiving the light guard device or for receiving the roller for winding up the shutter or shade of the device. The casing is glued into the space between the panes at the bottom thereof by means of an adhesive which can be softened by the application of heat for the purpose of replacing the light guard device.

The above-described, known insulating glass window has the disadvantage that the disassembly of the casing for replacing or repairing the light guard device is very labor-intensive and, thus, expensive. Another even more important disadvantage is the fact that a casing of this type cannot be integrated into the circumferentially extending sectional frame serving as spacer which is used in conventional insulating glass windows of today without changing the entire construction of such a window.

It is, therefore, the primary object of the present invention to provide a replaceable light guard device which can be easily integrated into an already existing insulating glass window of the conventional type and which does not require any casings or the like to be separately mounted on the outside of the spacer frame.

SUMMARY OF THE INVENTION

In accordance with the present invention, the entire light guard device is arranged in the space between the window panes and is supported in opposite frame sides of the sectional frame extending transversely of the direction of movement of the light guard sheet or web. At least one of the frame sides has an opening for the assembly and disassembly of the light guard device. The opening can be closed in a gas-tight manner by means of a cover.

The various features of novelty which characterize the invention are pointed out with particularity in the claims annexed to and forming a part of this disclosure. For a better understanding of the invention, its operating advantages attained by its use, reference should be had to the drawings and descriptive matter in which there are illustrated and described preferred embodiments of the invention.

DESCRIPTION OF THE PREFERRED EMBODIMENT

Figure 1:
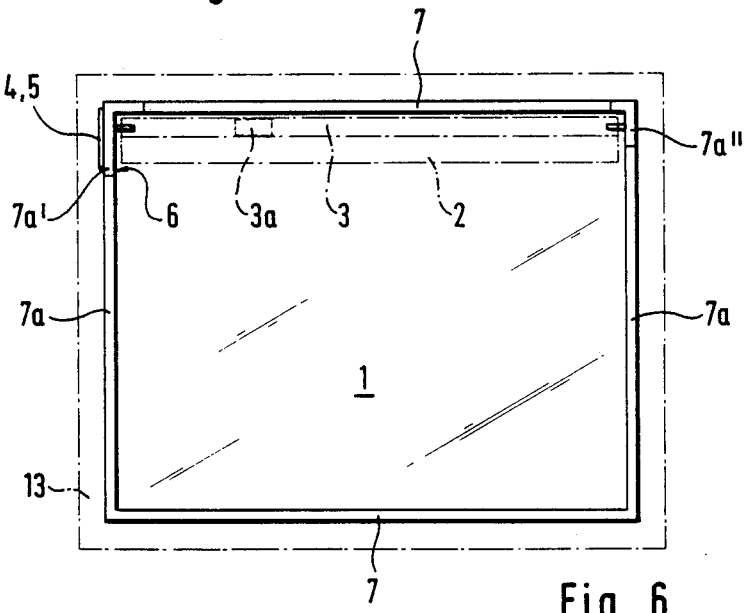
FIG. 1 is a schematic elevational front view of an insulating glass window according to the present invention with a light guard device mounted in the window.
Figure 2:
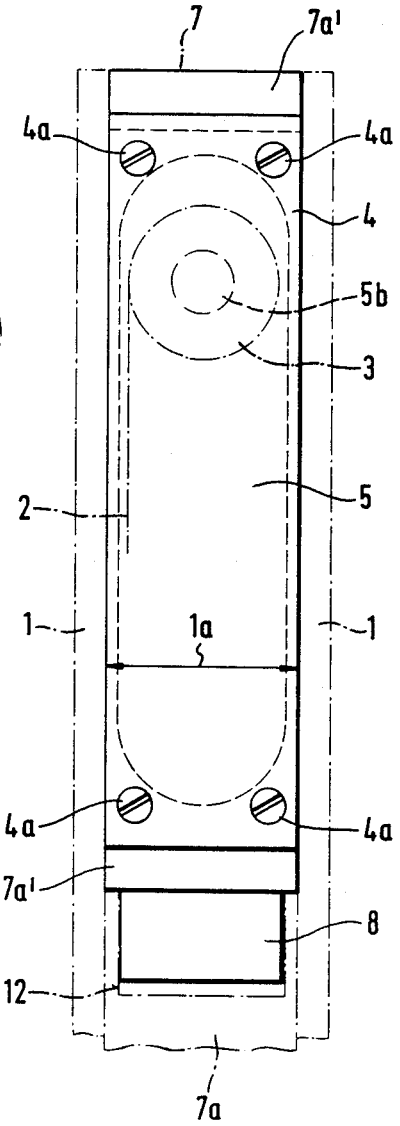
FIG. 2 is a side view, on a larger scale, of a portion of the window of FIG. 1.

FIGS. 1 and 2 of the drawing show an insulating glass window with two window panes 1 separated from each other by means of a sectional frame 7, **7*a* serving as a spacing member. The window includes a replaceable lock guard device 2, 3 in the form of a shutter or a shade with a light guard sheet or web which is movable in the space la between the panes. An electric motor 3*a* serves to drive the light guard device 2, 3**.

The novel feature 2, 3 of the present invention resides in that the entire light guard device 2, 3 is arranged in the space **1*a* between the panes and that the light guard device 2, 3 is supported at its ends in oppositely located frame sides 7*a* of the sectional frame extending transversely of the direction of movement of the light protection sheet. In addition, at least one of the frame sides 7*a* has an opening 6 to make it possible to assemble and disassemble the light guard device 2, 3. The opening 6 can be closed in a gas-tight manner by means of a cover 4, 5**.

Figure 3:
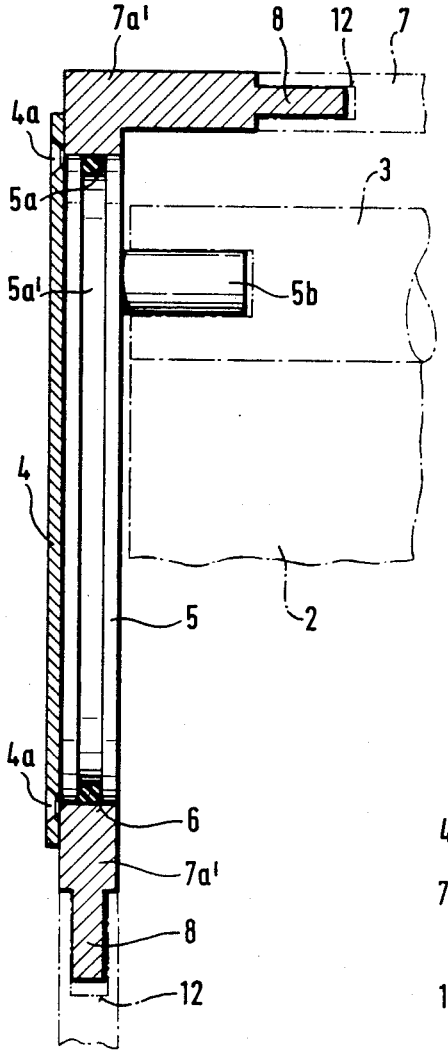
FIG. 3 is a partial longitudinal sectional view corresponding to FIG. 2.

As illustrated in detail in FIG. 3 of the drawing, in accordance with a special structural feature of the present invention, the cover includes a plate 4 with a raised insert 5 for fully filling out the opening 6 in the frame side **7*a*. The insert 5 has an O-ring seal 5*a* and a bearing pin 5*b* for the light guard device 2 facing to the space 1*a* between the panes. The, electric motor 3*a* is a tubular motor arranged together with the light guard device in the space 1*a* between the panes. Accordingly, all mechanical components of the sun guard device or light guard device 2 are fastened to the cover 4, 5 and can be assembled and disassembled together with the cover 4, 5. Fastening screws 4*a*** additionally ensure the gas-tight seat of the O-ring seal.

Figure 4:
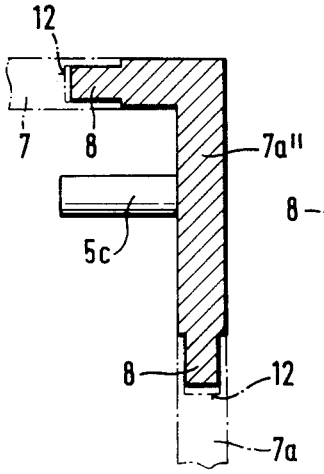
FIGS. 4 and 5 are sectional views, on a larger scale, of details of the window of FIG. 1.
Figure 5:
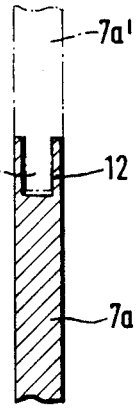

In accordance with another feature of the present invention illustrated in FIGS. 3–5, the portion **7*a*′ of the frame side 7*a* with the opening 6 and the portion 7*a*″ of the oppositely located frame side 7*a* carrying a support member 5*c* located opposite the opening 6 form separate structural components which are placed flush by means of connecting members 8 in the frame sides 7*a***.

Figure 6:
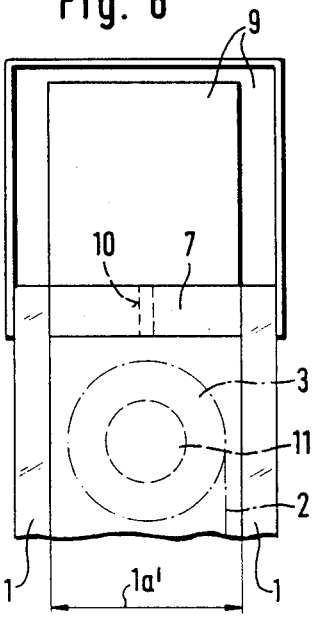
FIG. 6 is a partial side view of another embodiment of the insulating glass window according to the present invention.

In accordance with the embodiment of the present invention shown in FIG. 6, an electric motor 9 is placed separately on the front side on the sectional frame 7. A drive shaft extends through a passage 10 in the sectional frame 7 into the space **1*a*′** between the panes.

The embodiment illustrated in FIG. 6 is used, for example, when the usual space **1*a* between the panes is not sufficient for mounting the drive motor. The drive deflection onto the winding roller 3 is effected through an only schematically indicated gear assembly 11** with bevel gears, miter gears or worm gears.

In both embodiments of the present invention, the O-ring seal 5a is arranged in a cirumferentially extending groove 5a' of the insert 5.

Finally, the stability of the insulating glass window according to the present invention is further increased by angle-shaped corner components *7a'* and *7a''* of the frame carrying the bearing pins 5b and 5c. Connecting pieces 8 are integrally formed or worked with the angle components *7a'* and *7a''* at the free ends thereof.

While specific embodiments of the invention have been shown and described in detail to illustrate the application of the inventive principles, it will be understood that the invention may be embodied otherwise without departing from such principles.

We claim:

1. In an insulating glass window with two panes separate from each other by means of a sectional frame serving as a spacing member, a space being defined between the panes, the window further including a replaceable light guard device, the light guard device including a shutter with a light guard sheet, the sheet being movable in the space between the panes, and an electric motor for driving the light guard device, the entire light guard device being arranged in the space between the panes, the sectional frame having opposite frame sides extending transversely of the direction of movement of the light guard sheet, the light guard device being supported by the opposite frame sides, wherein the improvement comprises that at least one of the frame sides has an opening for the assembly and disassembly of the light guard device, and a cover for closing the opening in a gas-tight manner.

2. The insulating glass window according to claim 1, wherein the cover comprises a plate and a raised insert mounted on the plate, the insert being mounted flush in the opening, the insert including an O-ring seal and a bearing pin for supporting the light guard device, the bearing pin facing into the space between the panes.

3. The insulating glass window according to claim 2, wherein one of the frame sides includes a first structural component, the opening being defined in the first structural component, the oppositely located other frame side including a second structural component carrying a support member for the light guard device, and connecting members at each structural component for placing each structural component flush in the frame side.

4. The insulating glass window according to claim 2, wherein the insert includes a circumferential groove, the O-ring being placed in the groove.

5. The insulating glass window according to claim 3, wherein the structural components are angular, the connecting members being integrally formed with the angular structural components at a free end thereof.

* * * * *